United States Patent [19]

Abraham

[11] Patent Number: 5,058,221

[45] Date of Patent: Oct. 22, 1991

[54] COMBINATION OF A WHEELCHAIR AND A TRANSPORT DEVICE FOR TRANSPORTING A PATIENT

[76] Inventor: Aleyamma Abraham, 277 Washington St., Carteret, N.J. 07008

[21] Appl. No.: 643,240

[22] Filed: Jan. 18, 1991

[51] Int. Cl.[5] ..... A61G 5/00; A61G 5/10; A61G 7/10

[52] U.S. Cl. ..... 5/81 R; 5/81 B; 280/304.1; 280/87.021; 297/DIG. 4

[58] Field of Search ..... 5/81 R, 81 B, 86; 280/250.1, 304.1, 87.021; 297/DIG. 4, 337; 414/921

[56] References Cited

U.S. PATENT DOCUMENTS

| | | | |
|---|---|---|---|
| 2,596,055 | 5/1952 | Thomas | 280/304.1 |
| 3,355,211 | 11/1967 | Kölle | 297/346 |
| 4,155,588 | 5/1979 | Danziger et al. | 5/81 R |
| 4,288,124 | 9/1981 | Hamilton | 297/DIG. 4 |
| 4,305,601 | 12/1981 | Berge | 280/304.1 |
| 4,737,997 | 4/1988 | Lamson | 5/81 R |
| 4,797,960 | 1/1989 | Vaiana et al. | 5/81 R |
| 4,948,156 | 8/1990 | Fortner | 280/304.1 |

*Primary Examiner*—Alexander Grosz
*Attorney, Agent, or Firm*—Ezra Sutton

[57] ABSTRACT

The present invention provides a wheelchair with a movable seat and a patient transport device having a movable platform for transferring a patient between a wheelchair and a bed, toilet, etc. using the movable transport device.

6 Claims, 3 Drawing Sheets

COMBINATION OF A WHEELCHAIR AND A TRANSPORT DEVICE FOR TRANSPORTING A PATIENT

FIELD OF THE INVENTION

The present invention relates to a wheelchair and a device for transporting patients between a wheelchair and a second location, such as a bed or toilet.

BACKGROUND OF THE INVENTION

At the present time, it is difficult to transfer a patient from a wheelchair to a bed or toilet, and usually two people are required to carry the patient to and from the wheelchair.

It is an object of the present invention to provide a transport device to facilitate the transferring of the patient, so that the patient does not have to be lifted or carried during transfer, and therefore, the patient is much more secure from falling.

SUMMARY OF THE INVENTION

In accordance with the principles of the present invention, there is provided a combination of a wheelchair and a transport device for transporting patients from a wheelchair to a second location, which includes a wheelchair having a movable seat movable between a first position in which the patient is normally seated in the wheelchair and a second position in which the movable seat is in contact with the transport device, so that the patient may be moved from the movable seat to the transport device.

The transport device includes a movable base for moving the transport device into contact with the movable wheelchair seat, a vertical support pole supported on the movable base, and a movable platform surrounding the vertical support pole for supporting and moving the patient to the second location.

BRIEF DESCRIPTION OF THE DRAWINGS

Further objects, features, and advantages of the present invention will become apparent upon consideration of the detailed description of the presently-preferred embodiment, when taken in conjunction with the accompanying drawings wherein.

DETAILED DESCRIPTION OF THE PREFERRED EMBODIMENT

Figure 1:
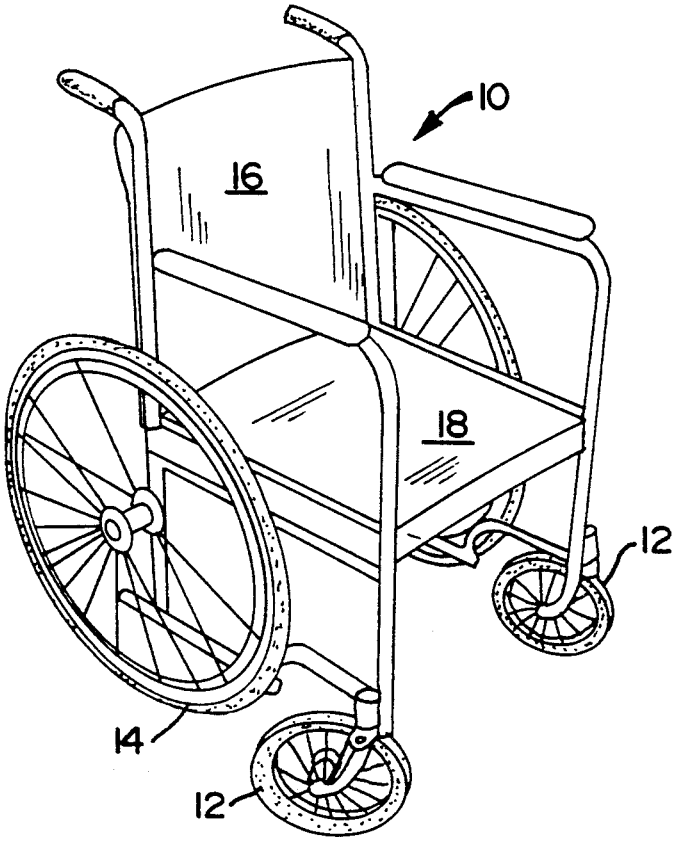
FIG. 1 is a perspective view of the wheelchair.
Figure 2:
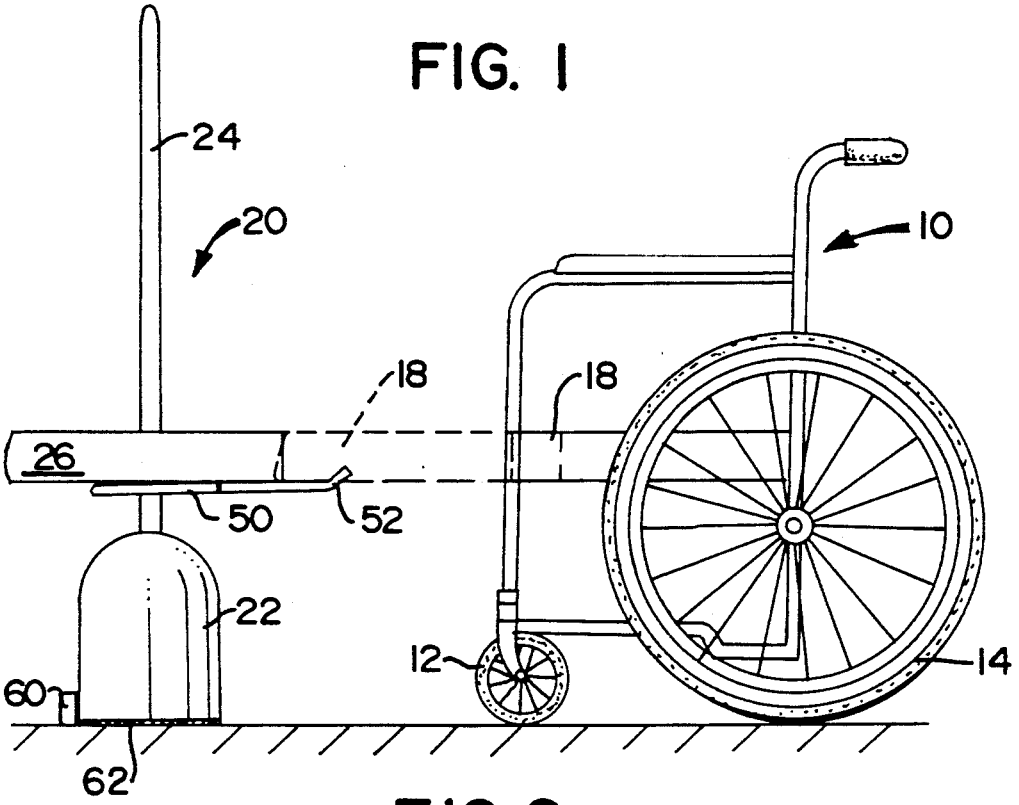
FIG. 2 is a side elevational view of the wheelchair and transport device.
Figure 3:
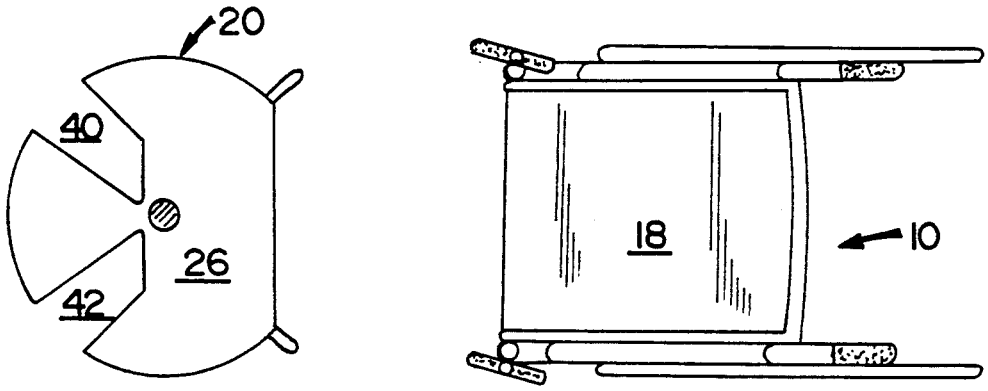
FIG. 3 is a top plan view.

FIG. 1 illustrates a wheelchair 10 having front wheels 12, rear wheels 14, back support 16, and movable seat 18 movable to the dotted line position shown in FIG. 2, wherein the seat 18 is in contact with the transport device 20.

As shown in FIG. 2, the transport device 20 includes a movable base 22 for moving the transport device 20 into contact with the movable seat 18, a vertical support pole 24 supported on base 22, and a movable platform 26 surrounding the vertical pole 24 for supporting and moving the patient to a second location.

Figure 6:
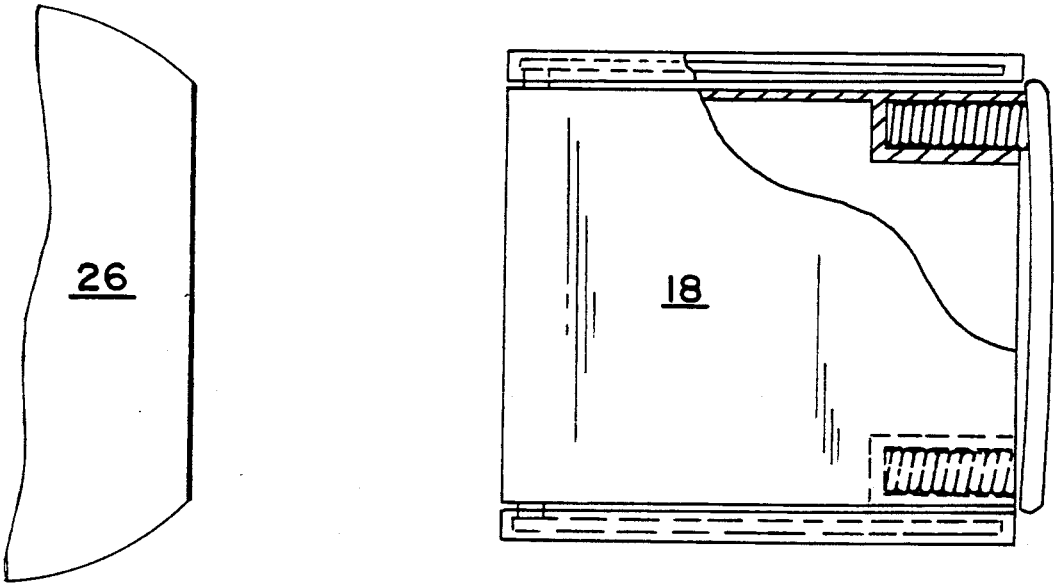
FIG. 6 is a top view of the movable seat.
Figure 7:
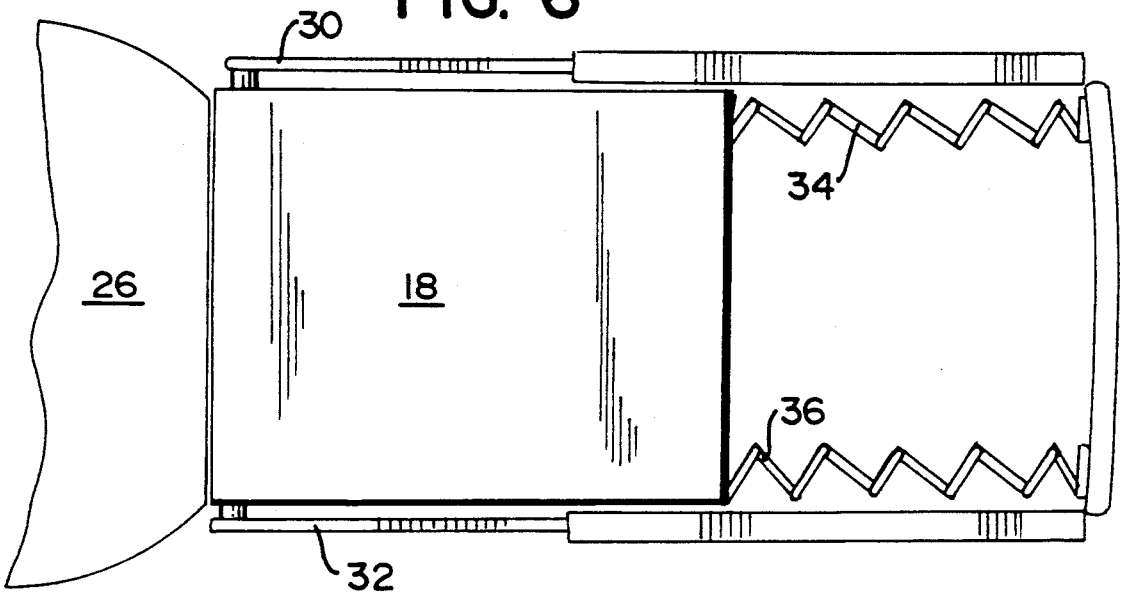
FIG. 7 is a top view of the movable seat in its extended position in contact with the transport device.

As shown in FIGS. 6 and 7, the movable seat 18 is mounted on slidable rods 30 and 32 for sliding the seat 18 between a first and a second position where the seat 18 is extended and is brought into contact with the platform 26. The seat 18 also includes springs 34 and 36 for retracting seat 18 to the first position, which is the normal, non-extended position for seat 18.

Figure 5:
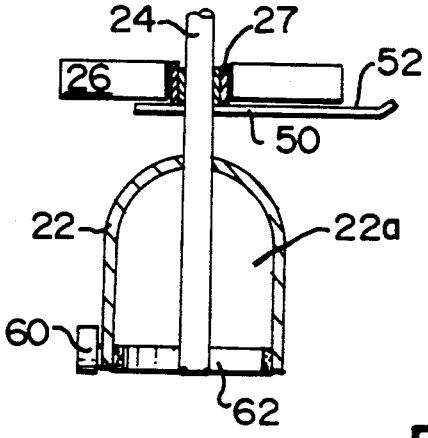
FIG. 5 is a partial cross-sectional view of the transport device shown in FIG. 2.

As shown in FIG. 5, the movable platform 26 is rotatable on bushings 27 about pole 24 and may be raised and lowered relative to pole 24 by handle 52. The platform 26 includes two leg openings 40 and 42 for receiving the legs of a patient during transport.

A support member 50 and an operating handle 52 are provided to raise, lower, and rotate the platform 26 relative to vertical support pole 24. The support member 50 supports the platform 26 on the support pole 24, so it can be moved relative to the support pole 24.

The bottom of the movable base 22 includes a wheel 60 and a vacuum seal 62 for gripping the floor during transport, so that the transport device 20 does not move while the patient is being transferred. A vacuum is maintained in the chamber 22*a*.

Figure 4:
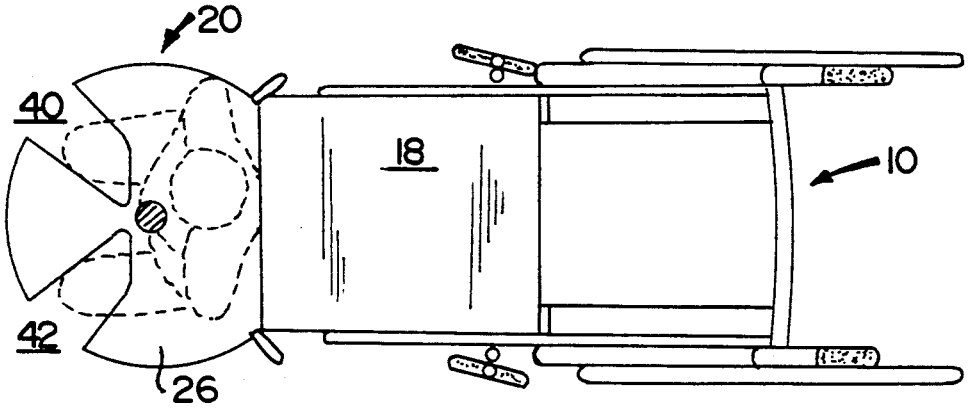
FIG. 4 is a top plan view showing the patient being transferred.

In operation, the seat 18 on the wheelchair is extended with the patient on it by sliding out the seat 18 into contact with platform 26 of transport device 20. The patient is then pushed and slid from the seat 18 onto the platform 26. This process is facilitated by the patient using his hands to grip the vertical pole support 24 and to thereby pull himself forwardly from the seat 18 and onto platform 26. As shown in FIG. 4, the patient's legs extend around pole 24 and then slide into leg openings 40 and 42, so that the patient is in a a sitting position on platform 26. The operating handle 52 is then used to raise or lower platform 26 to the desired height to transfer the patient to the second location, which may be a bed or a toilet. The platform 26 is also rotated to the desired position. When the patient is ready to be moved to the second location, the vacuum 62 is released, so that the transport device 20 and the patient can be transported to the desired second location. At the second location, the patient is pushed and slid from the transport device 20 to the bed, toilet, etc.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A combination of a wheelchair and a transport device for transporting patients from a wheelchair to a second location, comprising:

a) a wheelchair having a generally horizontally movable seat movable between a first retracted position in which the patient is normally seated in said wheelchair and a second extended position in which said movable seat is in contact with said transport device, so that the patient may be moved from said movable seat to said transport device;

b) said transport device including a movable base for moving said transport device into contact with said movable wheelchair seat, vertical support means supported on said movable base, and a movable platform surrounding said vertical support means sized for supporting a seated patient and moving said patient to said second location.

2. A combination in accordance with claim 1, wherein said wheelchair includes means for sliding said movable seat between said first and second positions, said sliding means including slidable rods to extend said movable seat to said second position and spring means to retract said movable seat to said first position.

3. A combination in accordance with claim 1, wherein said movable base includes vacuum means for supporting said base on the floor surface.

4. A combination in accordance with claim 1, wherein said vertical support means includes a vertical pole which the patient can hold onto while being transported from the wheelchair to said second location.

5. A combination in accordance with claim 1, wherein said movable platform includes means for rotating said platform about said vertical support means and means for vertically adjusting said movable platform relative to said vertical support means, so that the patient may be rotated and elevated or lowered during transport.

6. A combination in accordance with claim 1, wherein said movable platform includes two leg openings for receiving the legs of a patient during transport.

* * * * *